US007316598B1

(12) United States Patent
Lock

(10) Patent No.: US 7,316,598 B1
(45) Date of Patent: Jan. 8, 2008

(54) TOY CONSTRUCTION SET

(76) Inventor: Keith S. Lock, 819 Southern Pine Ln., Sarasota, FL (US) 34243

( * ) Notice: Subject to any disclaimer, the term of this patent is extended or adjusted under 35 U.S.C. 154(b) by 0 days.

(21) Appl. No.: 11/205,973

(22) Filed: Aug. 17, 2005

(51) Int. Cl.
*A63H 33/10* (2006.01)

(52) U.S. Cl. ..... 446/126; 446/85

(58) Field of Classification Search ..... 446/85, 446/108, 111, 113, 121, 122, 126
See application file for complete search history.

(56) References Cited

U.S. PATENT DOCUMENTS

| | | | | | |
|---|---|---|---|---|---|
| 1,092,217 | A | * | 4/1914 | Hopkins | 446/102 |
| 1,113,371 | A | * | 10/1914 | Pajeau | 446/126 |
| 1,347,808 | A | * | 7/1920 | Franklin | 403/119 |
| 3,069,805 | A | | 12/1962 | Burrows | |
| 3,469,339 | A | | 9/1969 | Thomas | |
| 4,078,328 | A | * | 3/1978 | Rayment | 446/102 |
| 4,274,222 | A | * | 6/1981 | Zahn et al. | 446/126 |
| 4,352,255 | A | * | 10/1982 | Warehime | 446/120 |
| 5,049,105 | A | * | 9/1991 | Glickman | 446/126 |
| 5,180,323 | A | | 1/1993 | Justice | |
| 5,282,767 | A | | 2/1994 | Gelardi | |
| 5,318,470 | A | * | 6/1994 | Denny | 446/126 |
| 5,385,472 | A | | 1/1995 | Mullin | |
| 5,451,177 | A | | 9/1995 | Gilman | |
| 5,480,336 | A | | 1/1996 | Blanchard | |
| 6,059,631 | A | | 5/2000 | Maddock | |
| 6,089,941 | A | * | 7/2000 | Glickman et al. | 446/111 |
| 6,273,778 | B1 | | 8/2001 | Kyster | |

* cited by examiner

*Primary Examiner*—John A. Ricci
(74) *Attorney, Agent, or Firm*—Charles J. Prescott

(57) ABSTRACT

A toy construction set including a plurality of elongated tubular elements each including first and second ends having identical outside diameters. A plurality of differently configured connectors each include a plurality of connecting legs having ends with identical inside diameters sized to closely mate and providing releasable engagement with the tubular elements. The connectors are individually configured to have preferably up to eight (8) connecting legs variously oriented one to another and radially extending from a focal point wherein the toy construction set is used to assemble a three-dimensional structure including a plurality of tubular elements releasably connected to a plurality of connectors.

7 Claims, 12 Drawing Sheets

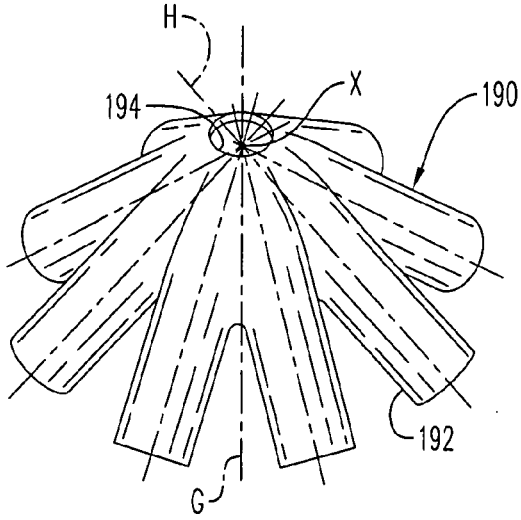
FIG. 26
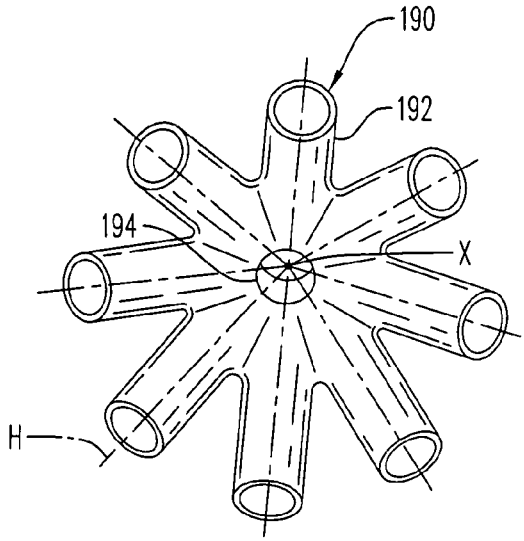
FIG. 27
FIG. 28
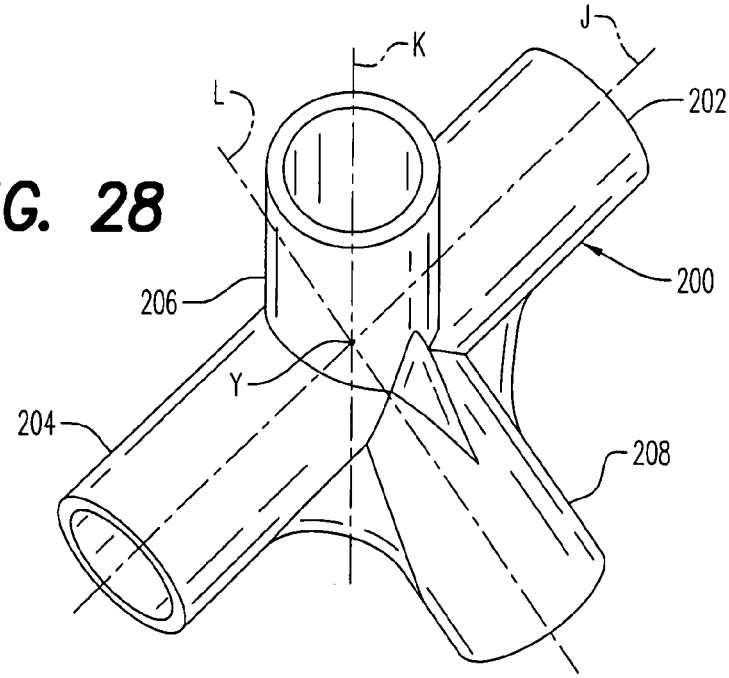

TOY CONSTRUCTION SET

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to children's toys designed to teach the assembly of geometric shapes into three-dimensional objects, and more particularly to a toy construction set which provides a broad variety of differently configured connectors for tubular elements which expand the horizon of imagination of children playing with this toy set.

2. Description of Related Art

Children, and even some adults, are intrigued and challenged with play sets which include elements utilized to form three-dimensional objects which of themselves are artistic and interesting to observe and to play with, and also further which accomplish a playful utilitarian function.

In U.S. Pat. No. 5,480,336 invented by Blanchard, a water toy construction kit is taught in which flexible elements and elongated mating tubular elements and connectors provide for the flow of water therethrough. This construction kit may be assembled in a variety of arrangements to add interest to the play set.

Mullin, in U.S. Pat. No. 5,385,472, also teaches a construction water toy which is designed for mounting onto a vertical surface such as that of a bathroom shower or bathtub wall. A variety of operational modes and arrangements are provided including forming the components of brightly colored transparent material to allow observation of the operation of each element. Whimsical and otherwise amusing shapes which enhance the entertainment value of the toy are also inherent therein.

In U.S. Pat. Nos. 5,282,767 by Gelardi, 5,451,177 to Gilman, and 6,273,778 to Kyster, all teach toy building sets providing unique connectors and ancillary structure which facilitate uniquely arranged releasable connection of the various elements to accomplish heightened amusement for children and adults alike.

The following additional U.S. patents are also known to applicant and represent a further expansion of this area of technology:

U.S. Pat. No. 3,469,339 to Thomas
U.S. Pat. No. 3,069,805 to Burrows
U.S. Pat. No. 5,180,323 to Justice
U.S. Pat. No. 6,059,631 to Maddock

BRIEF SUMMARY OF THE INVENTION

This invention is directed to a toy construction set including a plurality of elongated tubular elements each including first and second ends having identical outside diameters. A plurality of differently configured connectors each include a plurality of connecting legs each having ends with identical inside diameters sized to closely mate and providing releasable engagement with the tubular elements. The connectors are individually configured to have preferably up to eight (8) connecting ends variously oriented one to another and radially extending from a focal point wherein the toy construction set is used to assemble a three-dimensional structure including a plurality of tubular elements releasably connected to a plurality of connectors.

It is therefore an object of this invention to provide a children's construction-based toy including a plurality of elongated tubular members and a variety of connectors of different configurations which are connectable together to form two-dimensional and three-dimensional objects of further play and amusement.

It is another object of this invention to provide a toy construction set which provides for the construction of virtually an unlimited number of three-dimensional structures and, in combination with brightly colored pieces, further enhances the entertainment value of this invention.

Yet another object of this invention is to provide a toy construction set which promotes children's imaginations, along with a heightened entertainment value to encourage child development and early problem solving, color recognition and geometric shape recognition development.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIGS. 14 to 28 are perspective views of a plurality of additional connector configurations in accordance with aspects of the present invention.

DETAILED DESCRIPTION OF THE INVENTION

The various drawings generally present two general aspects of this invention. In one set of Figures, various three-dimensional objects constructed utilizing the tubular elements and uniquely configured connectors of the invention are shown. Additionally, the various configurations of the connectors are also shown in individual detail and are referenced to correspond to points of use within the examples of three-dimensional structure in the first portion of the drawings.

Figure 1:
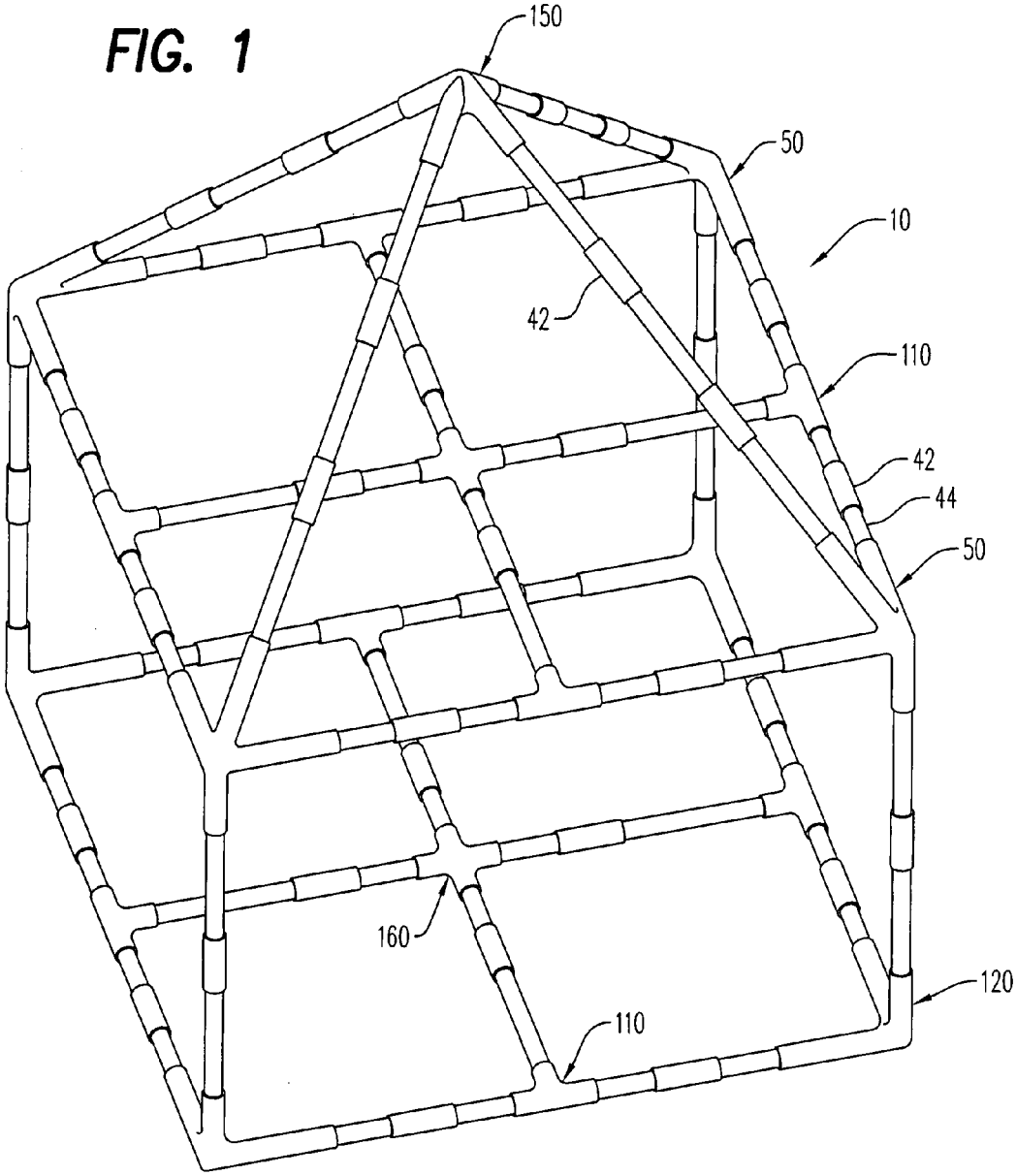
FIG. 1 is a perspective view of one example of a three-dimensional object constructed utilizing aspects of the present invention.

Referring now to these drawings, and firstly to FIG. 1, a three-dimensional toy simulated building-type structure is there shown generally at numeral 10. This structure 10 is formed utilizing a variety of the connectors shown at 42, 50, 110, 120, 150 and 160. These connectors are releasably connected together by selected lengths of elongated tubular elements shown typically at 44 and selected for compatible length to create this three-dimensional structure 10.

In general, the tubular elements shown typically at 44 are preferably elongated straight members (although arcuate configurations may also be used) having first and second ends which have identical outside diameters. Each of the connectors are formed having a plurality of connecting ends each having identical inside diameters which are sized to closely mate and provide releasable engagement with the ends of the tubular elements.

Figure 4:
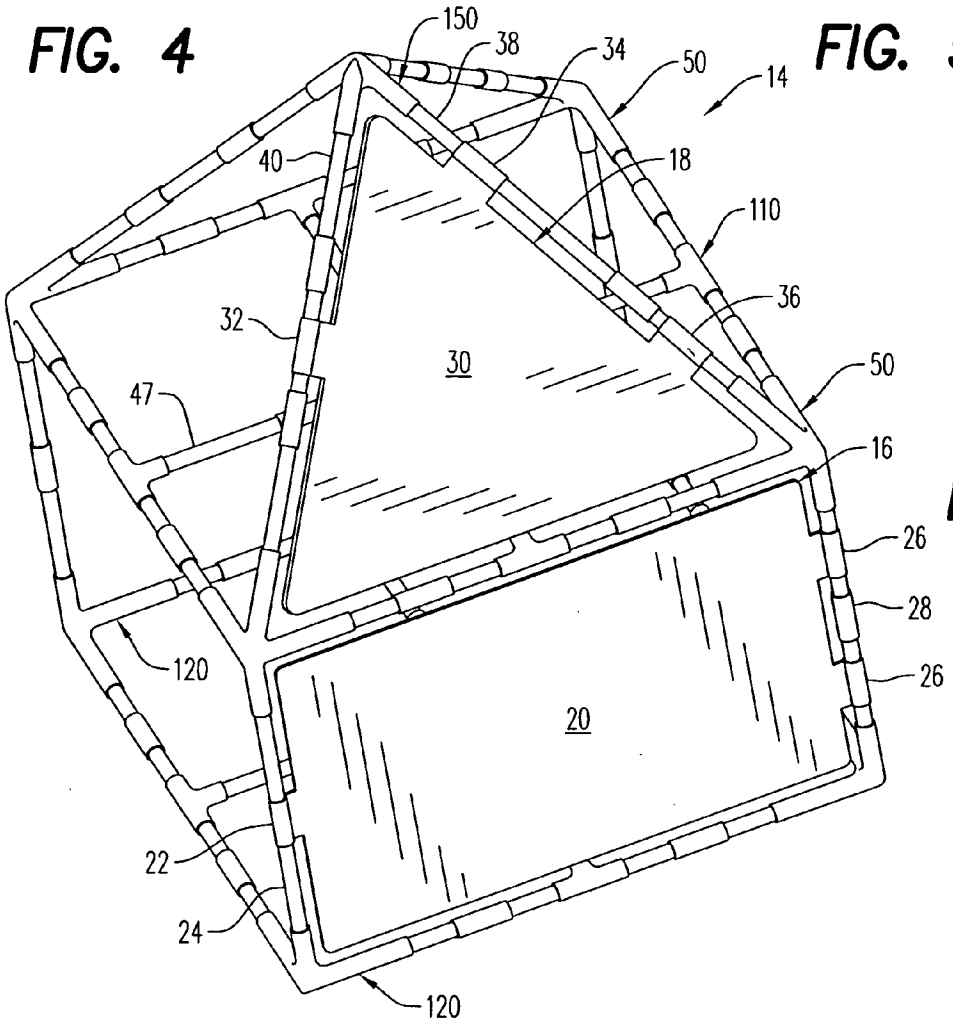
FIG. 4 is a perspective view of yet another three-dimensional object constructed utilizing features of the present invention and including releasably interconnectable panels for enhancement thereof.
Figure 4A:
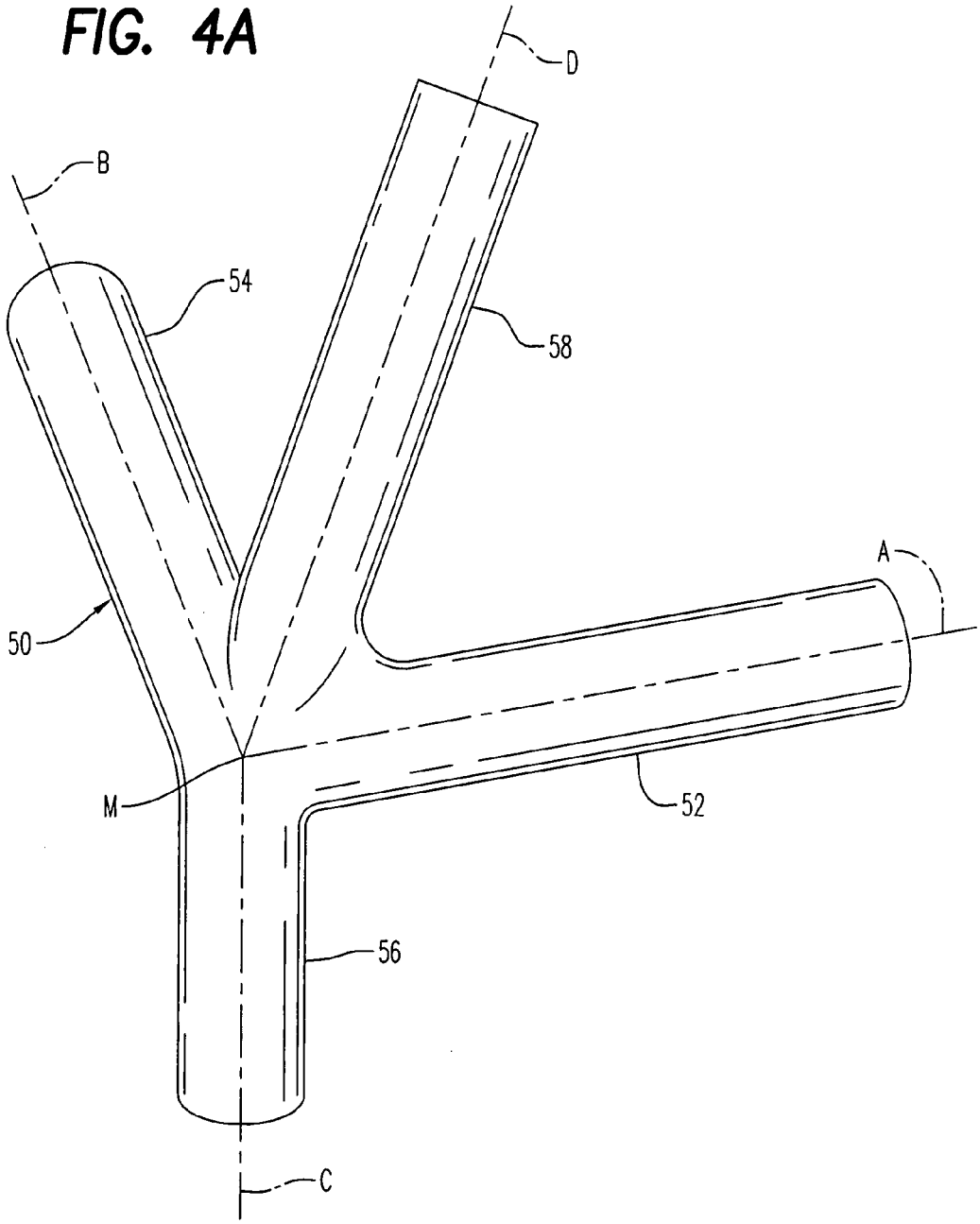
FIG. 4A is a perspective view of one embodiment of a connector of the present invention.

One connector 42 utilized in the embodiment 10 is that of a generally straight, double-ended connector structured to expand the available length between other connectors such as 50 and 110. Connector 50 is best seen in FIG. 4A and includes a total of four divergently extending connector legs 52, 54, 56 and 58, each of which have central longitudinal axes which converge at focal point M. Longitudinal axes A, B and C emanate from this focal point M and are orthogonally oriented three-dimensionally one to another. The fourth longitudinal axis D of connector leg 58 is oriented at approximately 45 degrees or any convenient acute angle with respect to the plane defined between axis A and B. Again, the ends of each of these tubular connector legs 52, 54, 56 and 58 have identical inside diameters releasably engageable with the tubular elements.

Figure 15:
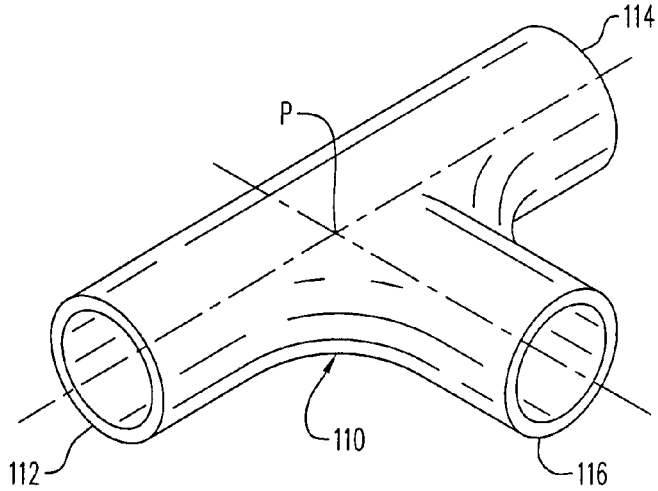

Connector 110 is shown in detail in FIG. 15 and includes connector ends 112 and 114 formed along a central longitudinal axis therebetween in coaxial orientation therebetween. The third connector end 116 is formed orthogonally to connector ends 112/114, the longitudinal axis of which intersects the central axis at focal point P.

Figure 16:
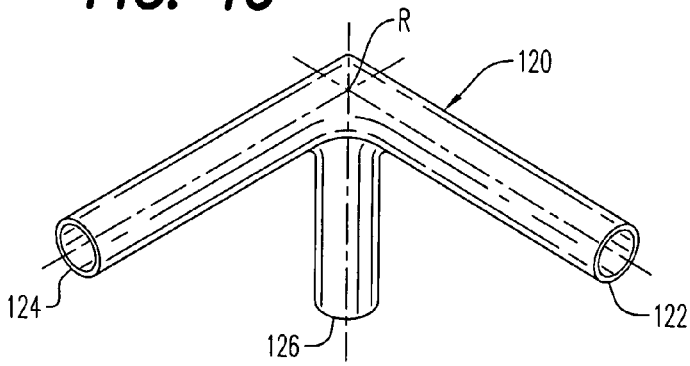

Connector 120, best seen in FIG. 16, is formed having three legs 122, 124 and 126, each of which are orthogonal to one another and having central longitudinal axes which intersect at focal point R. This connector 120 is essentially utilized for example at any three-dimensional building type corner structure with orthogonally oriented simulated walls and floor panels.

Figure 21:
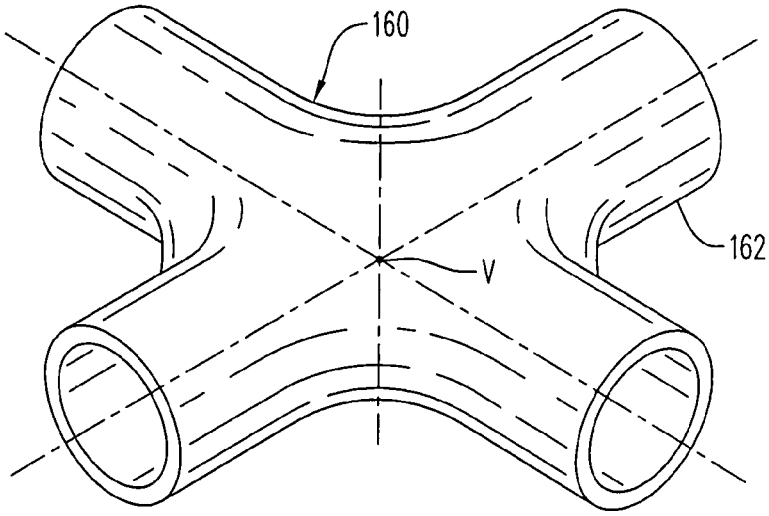
Figure 22:
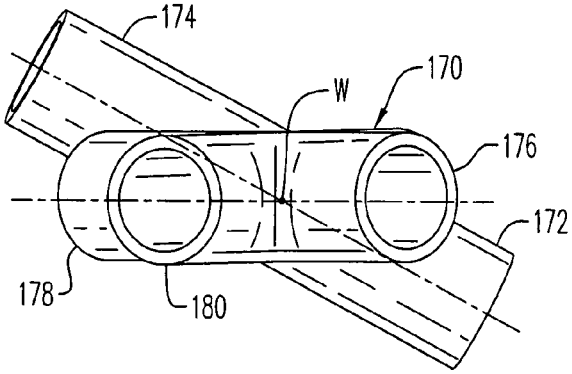
Figure 23:
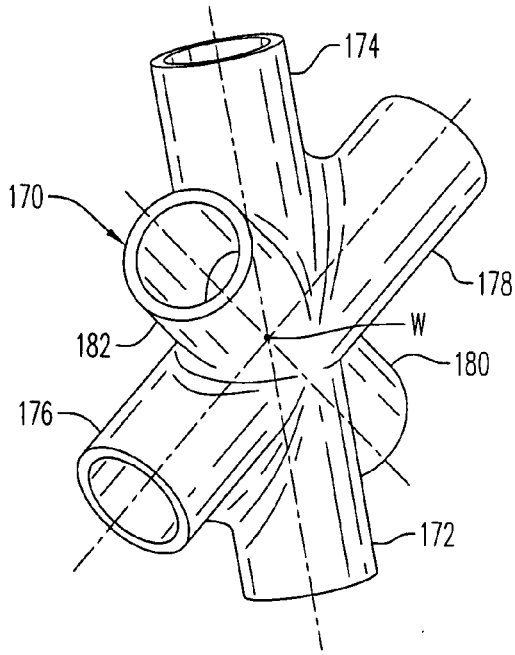

Connector 160 shown in FIG. 21 includes a plurality of connector legs 162 orthogonally oriented one to another and lying in a plane. The longitudinal axes of these connector legs 162 converge at focal point V and lie in a common plane passing therethrough.

Figure 2:
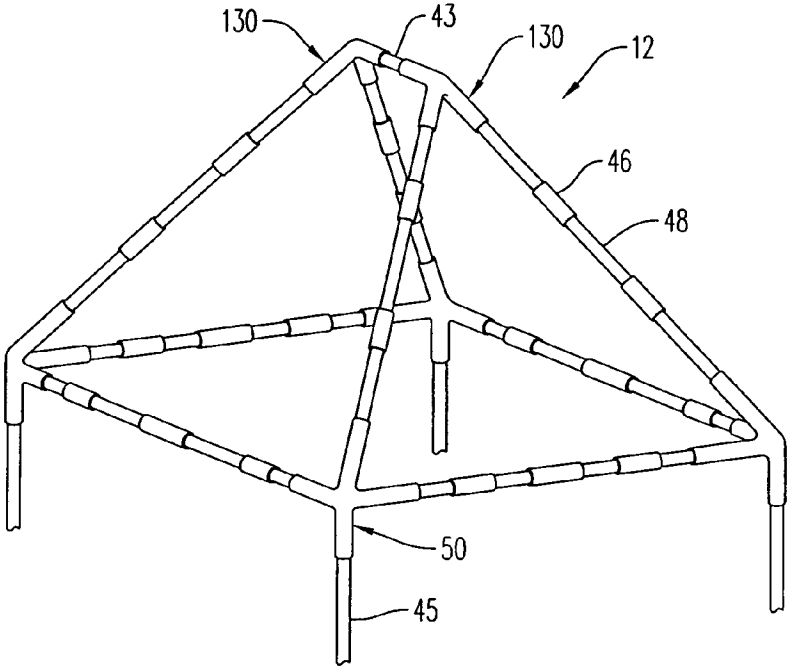
FIG. 2 is a perspective view of another three-dimensional object constructed utilizing aspects of the present invention.
Figure 3:
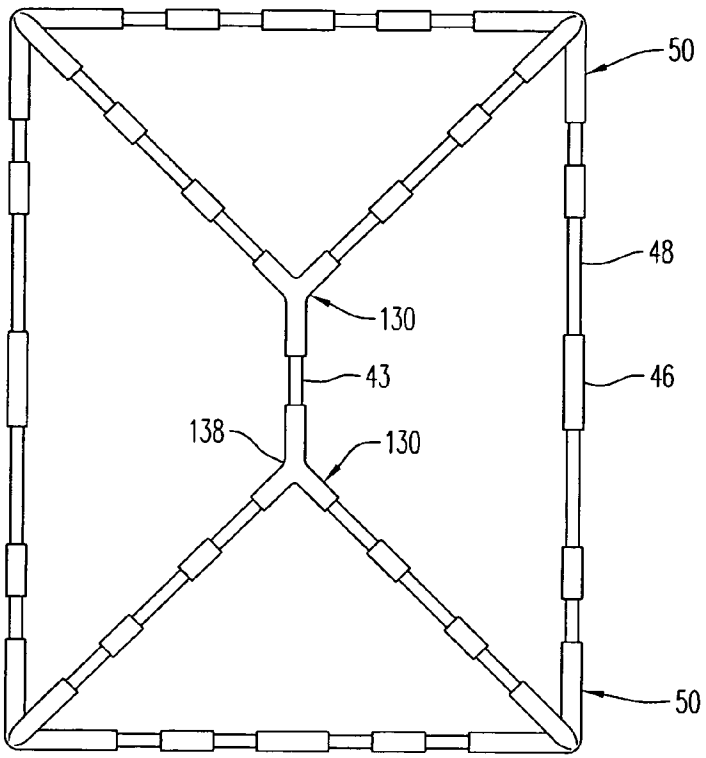
FIG. 3 is top plan view of FIG. 2
Figure 5:
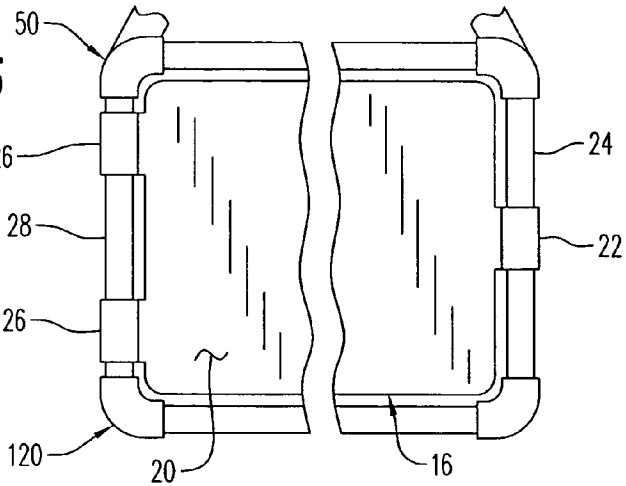
FIG. 5 is a front elevation view of a side panel portion of FIG. 4.
Figure 6:
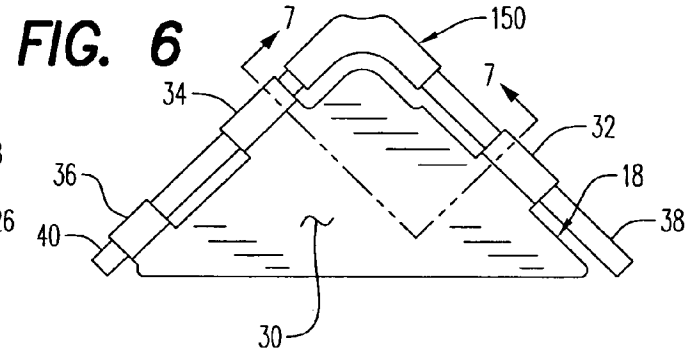
FIG. 6 is a front elevation view of an upper triangular panel portion of FIG. 4.
Figure 17:
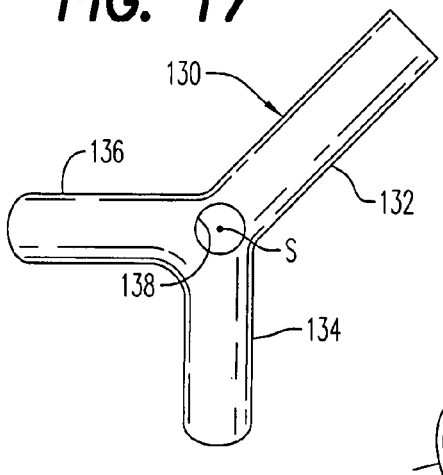
Figure 18:
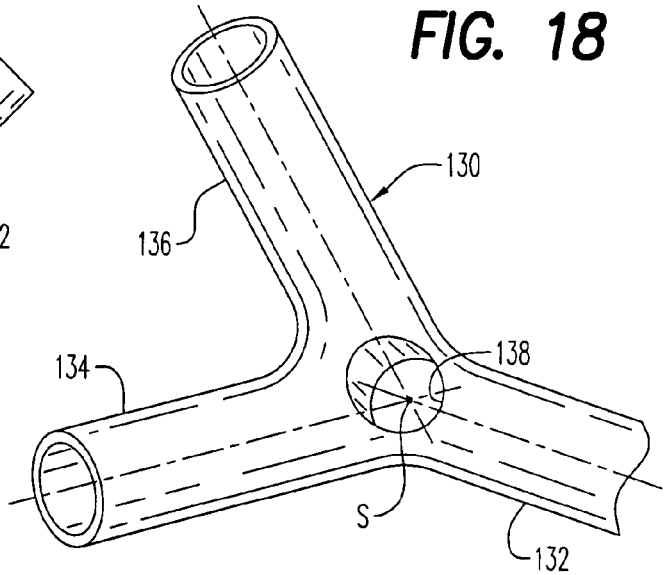

In FIGS. 2 and 3, another three-dimensional embodiment of the construction features of the invention is there shown generally at numeral 12 and simulates a pyramid-like roof of a building structure. In this construction embodiment 12, elongated tubular elements 43, 45 and 48 are utilized in conjunction with connectors 50 and 130. Connector 46 is elongated in form for greater longitudinal span and stiffening features. Connector 130 is seen in FIGS. 17 and 18. This connector 130 includes three connector legs 132, 134 and 136 each having ends sized as previously described and non-orthogonal longitudinal axes which converge at focal point S. The preferred angle between connector legs 134 and 136 is in the range of 60 degrees while the angular orientation between the plane lying through the axes of connector legs 134 and 136 and that of connector leg 132 is in the range of 135 degrees. In this connector embodiment 130, the addition of a construction extension aperture 138 is there shown. This aperture is sized to slidably or snugly receive a tubular element passing therethrough which would facilitate expansion of the geometric shape into multiple chambers, building phases and the like.

Referring now to FIGS. 4 to 7, a more complete three-dimensional simulated building structure is there shown generally at numeral 14. In this embodiment 14, elongated tubular elements, including tubular element 47 spanning transversely horizontally through the center of this structure 14, are utilized to interconnect the connectors 50, 110, 120, and 150 as previously described.

Figure 7:
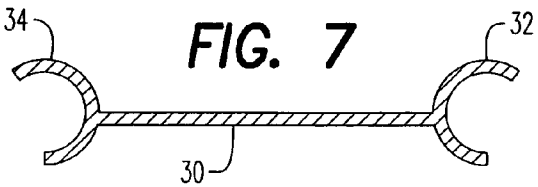
FIG. 7 is a cross sectional view in the direction of arrows 7-7 in FIG. 6.

In this embodiment 14, the addition of flat panels 20 and 30 enhance this geometric building-like structure 14. Each of these flat panels 20 and 30 are formed of thin transparent or opaque material, preferably thin sheet plastic material having tubular connectors 22/26 attached to opposite margins of rectangular panel 20 and tubular connectors 32, 34 and 36 attached to opposing margins of panel 30. As best seen in FIG. 7, these connectors, shown typically at 32 and 34 snapably engage over closely spaced tubular element, typically at 38 and 40 of the three-dimensional structure 14.

Figure 8:
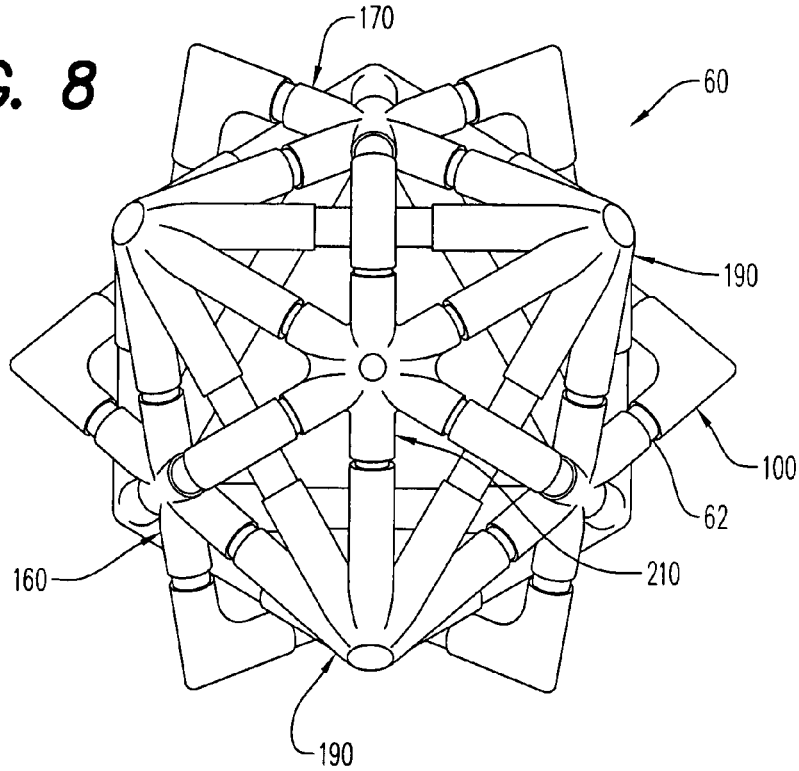
FIGS. 8, 9 and 10 are perspective views of uniquely configured three-dimensional objects constructed in accordance with the aspects of present invention.
Figure 9:
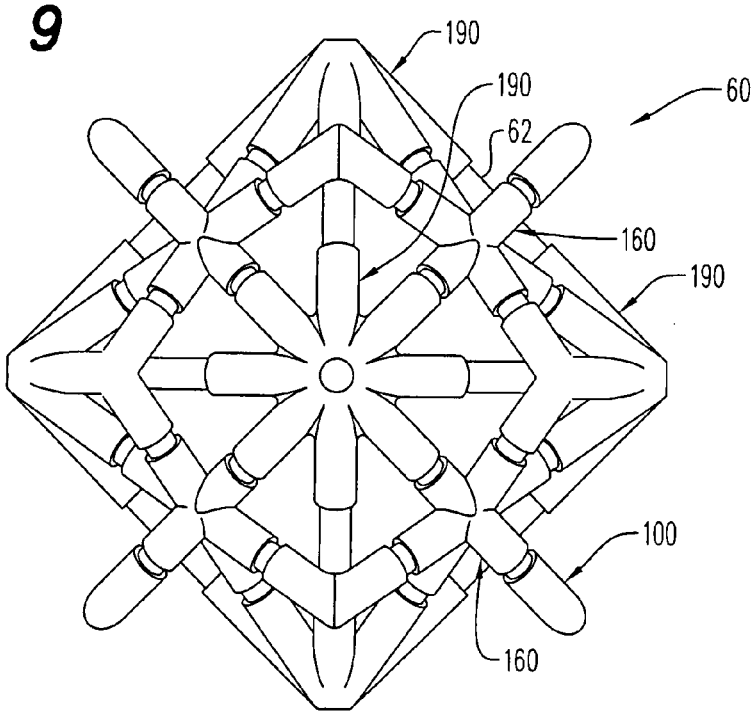

In FIGS. 8 and 9, a very unique three-dimensional geometric structure is there shown generally at numeral 60. This structure 60 is formed utilizing a plurality of eight-legged connectors 190 shown in detail in FIGS. 26 and 27. This connector 190 includes a plurality of eight radially extending connector legs shown typically at 192 having a longitudinal axis therethrough shown typically at H. These longitudinal axes H intersect at a focal point X, the connector 190 having a common axis G also passing through this focal point X. The preferred orientation between axes H and central axis G is 45 degrees or at any other acute angle desired.

Note that an aperture 194 is also provided in this embodiment 190 extending longitudinally along the central axis G and again sized to snugly receive the outside diameter of any of the tubular elements forming a part of this invention to heighten the complexity of building aspect of this invention.

Figure 24:
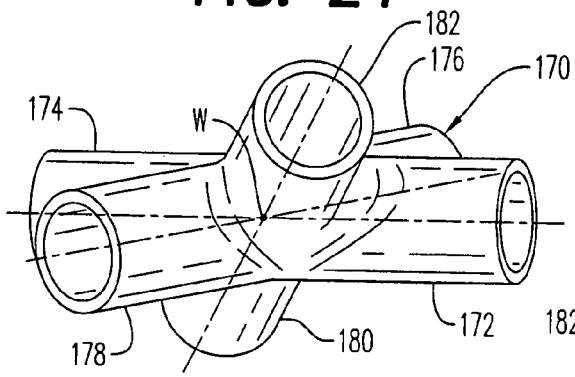
Figure 25:
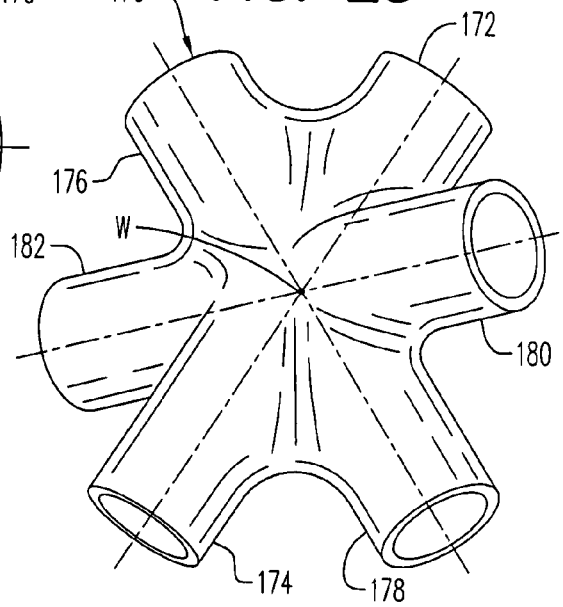

This embodiment 60 also includes a central connector 210 having six orthogonally oriented radially extending connector legs as shown. An additional six-legged connector 170 seen in FIGS. 24 and 25 includes aligned connector legs 172 and 174 which are lying in a plane oriented at approximately 30 degrees to another plane defined by the remaining connector legs 176, 178, 180 and 182. This offset of two of the six connector legs provides for heightened interesting geometric construction. Small tubular elements 62 and 90° elbows 100 are also utilized to form this very unique geometric three-dimensional design 60.

Figure 10:
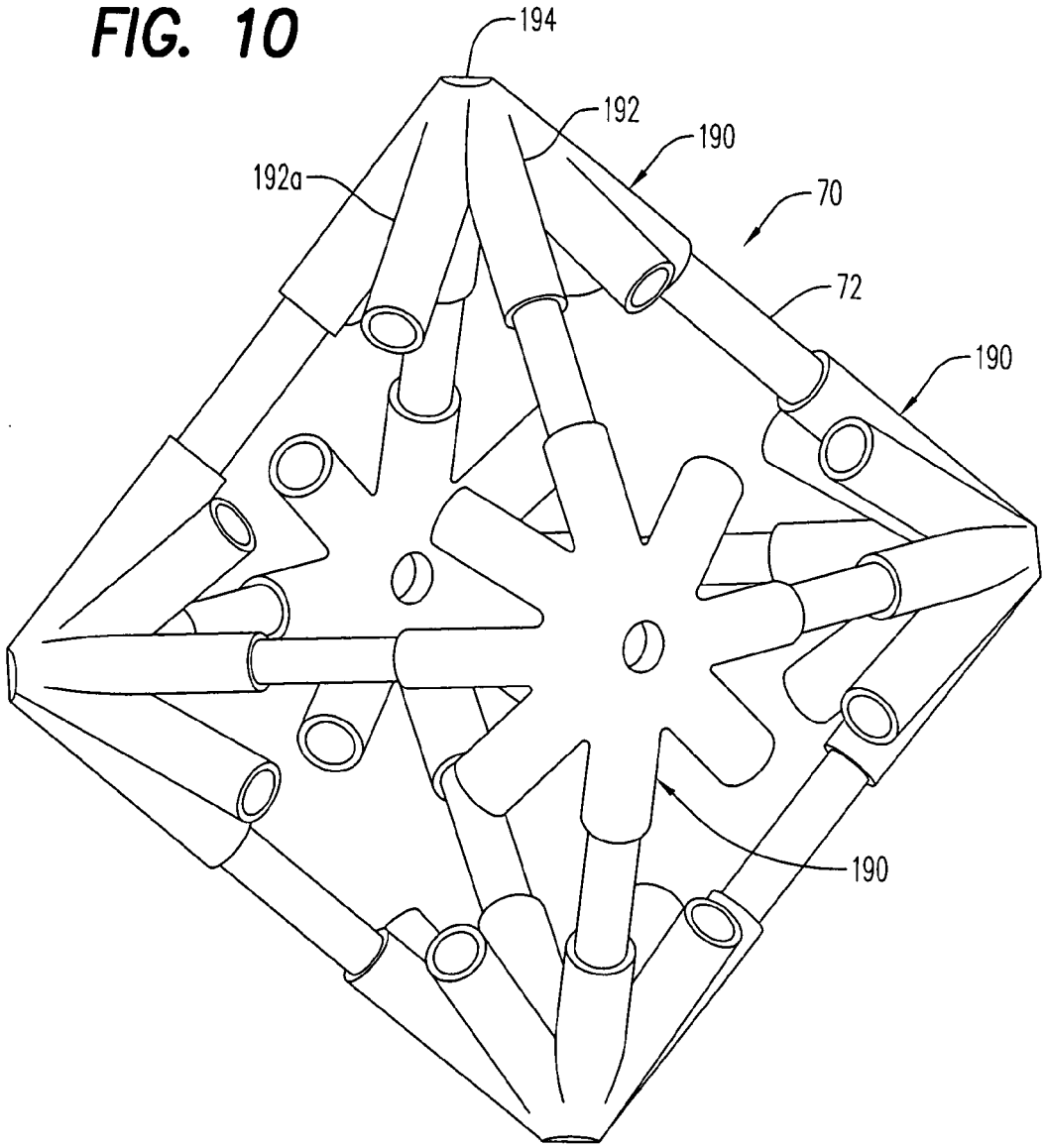
Figure 11:
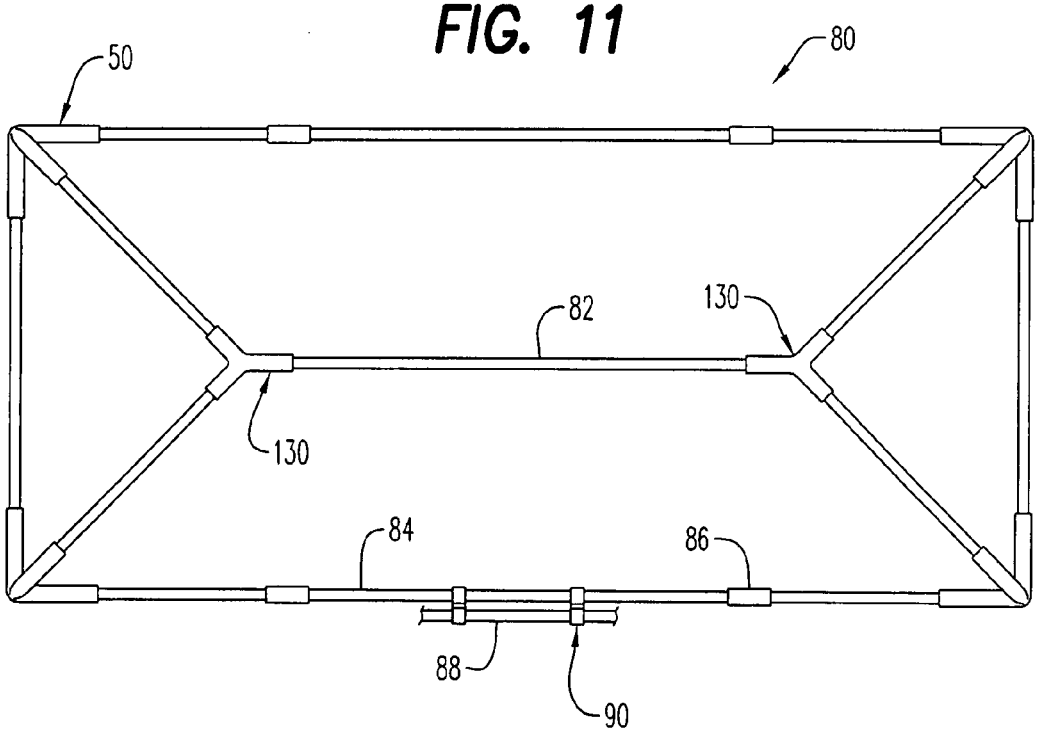
FIG. 11 is a top plan view of still another three-dimensional object constructed in accordance with aspects of the present invention.
Figure 12:
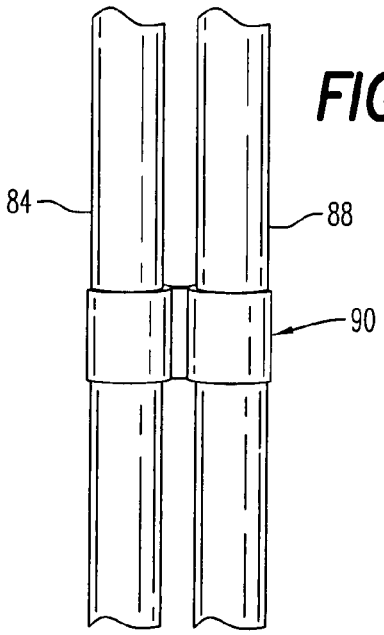
FIG. 12 is an enlarged view of an edge portion of FIG. 11 showing releasable interconnection between parallel elongated tubular elements.
Figure 13:
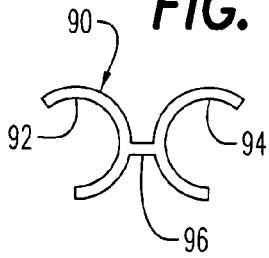
FIG. 13 is an end elevation view of the attachment of FIGS. 11 and 12.
Figure 14:
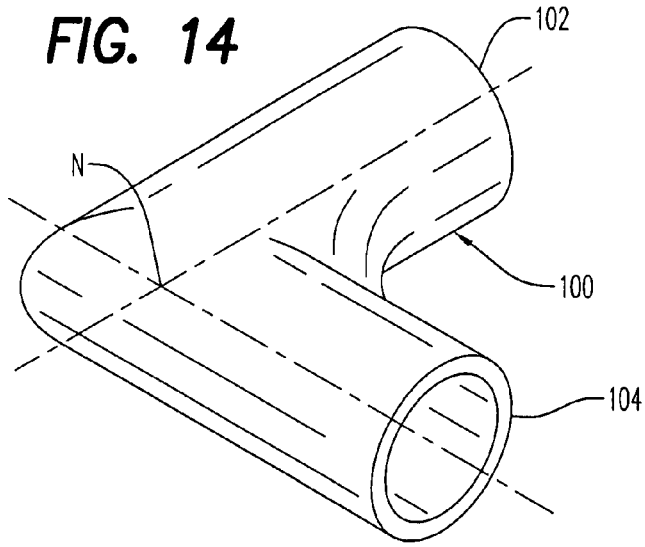

FIG. 10 presents another interesting three-dimensional geometric structure 70 which exclusively utilizes six of the eight-legged connectors 190 as previously described. Alternate connector legs 192 are interconnected to common lengths of tubular elements 172 while alternate connector legs 192*a* are left empty.

Figure 19:
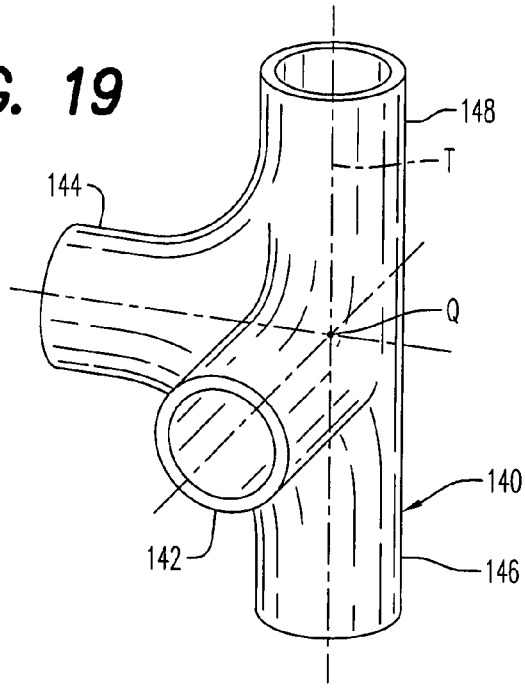
Figure 20:
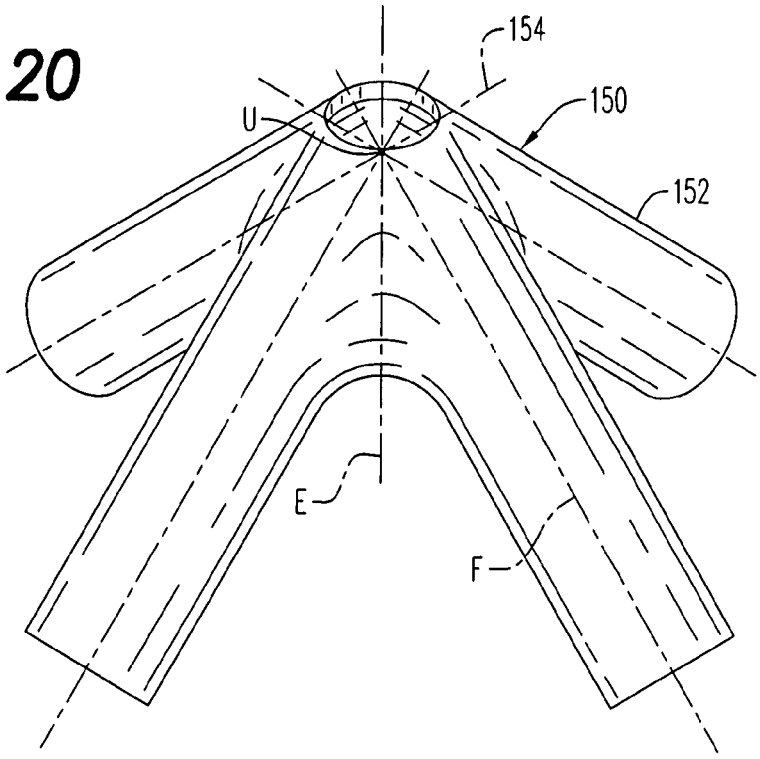

Referring lastly to FIGS. 19 and 28, two additional embodiments of connectors are there shown generally at numerals 140 and 200, respectively. Connector 140 includes four connector legs 142, 144, 146 and 148, legs 146 and 148 being substantially continuous and straight about the central longitudinal axis T thereof which intersects the axes orthogonally of legs 142 and 144 to define focal point Q. Leg 148 is foreshortened and may be utilized to extend a geometric shape into a second geometric shape for expanded versatility utilizing this connector 140.

Connector 200 includes connector legs 202, 204, 206 and 208 which are substantially shorter than those of connector 50 where a three-dimensional geometric structure is enhanced utilizing the shorter legs of connector 200. Legs 202 and 204 are collinear about axis J while legs 206 and 208 have axes K and L, are orthogonal to axis J and being oriented at an obtuse angle, preferably 136 degrees, to one another. The longitudinal axes J, K and L intersect at focal point Y.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A toy construction set comprising:

a plurality of elongated tubular elements each including first and second ends having identical outside diameters;

a plurality of connectors each differently configured one to another and including a plurality of connecting legs having connecting ends each having identical inside diameters sized to closely mate and providing releasable engagement with said tubular elements;

a first one of said plurality of connectors being configured as an elbow having two of said connecting ends oriented at up to 90 degrees one to another;

a second one of said plurality of connectors being configured to include only three divergently extending legs each having one of said connecting ends;

a third one of said plurality of said connectors being configured to include four divergently extending legs each having one of said connecting ends;

said toy construction set being used to assemble a three-dimensional structure including a plurality of said tubular elements releasably connected to a plurality of said connectors;

each of said connecting legs of each of said plurality of connectors having a central longitudinal axis, all of said axes of each said connector intersecting at a central focal point defined thereby;

at least one of said connectors including a central aperture at said focal point sized to equal said inside diameter for releasable connection with said tubular elements;

said legs of one said connector being spaced radially one to another and oriented at a common acute angle to the central axis.

2. A toy construction set as set forth in claim 1, further comprising:

a fourth of said plurality of said connectors being configured to include six divergently extending legs each having one of said connecting ends;

said fourth connector including a portion of said legs lying in a first plane and a remainder of said legs lying in a second plane oriented at an acute angle to said first plane.

3. A toy construction set as set forth in claim 1, further comprising:

releasable snap-on connectors configured for interconnection between closely spaced tubular elements of adjacent three-dimensional structures.

4. A toy construction set comprising:

a plurality of elongated straight tubular elements each including first and second ends having identical outside diameters;

a plurality of connectors each differently configured one to another and including at least three connecting legs having connecting ends each having identical inside diameters sized to closely mate and providing releasable engagement with said tubular elements;

each of said connecting legs of each of said plurality of connectors having a central longitudinal axis, all of said axes of each said connector intersecting at a central focal point defined thereby;

at least one of said connectors including a central aperture passing through said focal point and sized to equal said inside diameter for releasable connection with said tubular elements;

said legs of at least one said connector spaced radially one to another and oriented at a common acute angle to the central axis thereof.

5. A toy construction set as set forth in claim 4, wherein:

one said connector including a portion of said legs lying in a first plane and a remainder of said legs lying in a second plane oriented at an acute angle to said first plane.

6. A toy construction set comprising:

a plurality of elongated tubular elements each including first and second ends having identical outside diameters;

a plurality of connectors each differently configured one to another and including a plurality of connecting legs having connecting ends each having substantially identical inside diameters sized to closely mate and providing releasable engagement with said tubular elements;

a first one of said plurality of connectors being configured as an elbow having two of said connecting ends oriented at up to 90 degrees one to another;

a second one of said plurality of connectors being configured to include only three divergently extending legs each having one of said connecting ends;

a third one of said plurality of said connectors being configured to include four divergently extending legs each having one of said connecting ends;

said toy construction set being used to assemble a three-dimensional structure including a plurality of said tubular elements releasably connected to a plurality of said connectors;

each of said connecting legs of each of said plurality of connectors having a central longitudinal axis, all of said axes of each said connector intersecting at a central focal point defined thereby;

at least one of said connectors including a central aperture passing through said focal point and sized to equal said inside diameter for releasable connection with said tubular elements;

said legs of at least one said connector evenly spaced radially one to another and oriented at a common acute angle to the central axis thereof.

7. A toy construction set comprising:

a plurality of elongated tubular elements each including first and second ends having identical outside diameters;

a plurality of connectors each differently configured one to another and including a plurality of connecting ends having identical inside diameters sized to closely mate and providing releasable engagement with said tubular elements;

said toy construction set being used to assemble a three-dimensional structure including a plurality of said tubular elements reasonably connected to a plurality of said connectors;

a plurality of panels each of different geometry shape and configured for reasonable engagement to said tubular elements which form a perimeter similarly shaped to that of one said panel;

said releasable engagement including opposing tubular snap-on connectors formed as a part of, and positioned along at least two opposing edges of each perimeter of said panels and being configured for snap over inter-connection over closely spaced tubular elements of adjacent three-dimensional structures.

* * * * *